US006371285B1

(12) United States Patent
DuBois

(10) Patent No.: US 6,371,285 B1
(45) Date of Patent: Apr. 16, 2002

(54) JEWELRY SAFE STORAGE DEVICE

(76) Inventor: Tiena L. DuBois, 13090 N. Ralston Rd., Maricopa, AZ (US) 85239

( * ) Notice: Subject to any disclaimer, the term of this patent is extended or adjusted under 35 U.S.C. 154(b) by 0 days.

(21) Appl. No.: 09/608,115

(22) Filed: Jul. 3, 2000

Related U.S. Application Data

(60) Provisional application No. 60/147,776, filed on Aug. 9, 1999.

(51) Int. Cl.[7] ..... A47F 7/02
(52) U.S. Cl. ..... 206/6.1; 223/98; 211/85.2
(58) Field of Search ..... 206/6.1, 457, 495; 223/98; 211/85.2

(56) References Cited

U.S. PATENT DOCUMENTS 3,900,060 A * 8/1975 Shammas ..... 206/6.1
4,735,246 A * 4/1988 Nichaus ..... 206/6.1
D313,906 S * 1/1991 Lubin ..... D6/467
5,031,758 A * 7/1991 Gonzalez ..... 206/6.1
5,246,103 A * 9/1993 Hicks ..... 206/6.1
5,295,587 A * 3/1994 Downes et al. ..... 211/13
5,363,953 A 11/1994 Carter ..... 206/6.1
5,427,230 A 6/1995 Mattox ..... 206/6.1
5,509,588 A * 4/1996 Kimball ..... 223/98
5,617,948 A * 4/1997 Rainey ..... 206/6.1
5,671,849 A * 9/1997 Bacon ..... 211/13
5,680,928 A 10/1997 Carr ..... 206/6.1
5,779,033 A 7/1998 Roegner ..... 206/6.1
6,161,686 A * 12/2000 Simon et al. ..... 206/6.1

* cited by examiner

*Primary Examiner*—David T. Fidei
(74) *Attorney, Agent, or Firm*—Joseph W. Mott

(57) ABSTRACT

A secure storage device for jewelry and other small items is disclosed. A fabric exterior is made to look like the upper portion of an article of clothing such as a blouse, sweater, or shirt and in use is hung on a standard coat hanger in a hotel closet or at home. A plurality of attachment devices on the inside back surface hold individual jewelry pieces for ready selection and access, and the device may be closed along the front and bottom to both secure and obscure the presence of its contents.

10 Claims, 2 Drawing Sheets

JEWELRY SAFE STORAGE DEVICE

This application claims the benefit of provisional application Serial No. 60/147,776, filed Aug. 9, 1999. The disclosure of the provisional application is expressly incorporated by reference herein.

FIELD OF THE INVENTION

The present invention is a jewelry storage device for placement in a closet. The device may conveniently be used at home or when traveling.

BACKGROUND OF THE INVENTION

Temporary storage of jewelry, particularly for travelers, presents a problem of balancing ready accessibility with a level of safety from theft. Many jewelry items, such as rings or earrings, are very small and can be difficult to find in a compartment of a suitcase or any other travel carrier. If placed in a pouch or hard-sided case, items may tumble against each other, causing scratches or other undesirable markings. Selecting particular items may require dumping out all the contents of the container, increasing the risk of damaging or losing a piece.

Prior art devices meet some needs in a limited way. U.S. Pat. No. 5,779,033 (Roegher) discloses a foldable, elongated carrying case for jewelry that incorporates a hook permitting it to be hung in a closet. Individual holders and catches permit attachment of items for easy selection and accessibility. However, this case design looks like it contains small items and would attract the attention of a thief rifling through a closet.

U.S. Pat. No. 5,680,978 (to Carr) discloses a jewelry storage apparatus comprising one or more cards. Attached to the card are flexible retainer members, made of rubber or flexible plastic, which hold the jewelry. A cover over the entire card is available for travel use.

U.S. Pat. No. 5,427,230 (to Mattox) discloses a jewelry holder adapted to be hung from a clothes hanger or other suitable rod by a pair of mounting straps. A flexible mesh sheet is suspended below the hanger and incorporates a plurality of fabric segments on which jewelry items may be attached.

U.S. Pat. No. 5,363,953 (to Carter) discloses a flexible screen or mesh for receiving the shaft or hook-like structures of jewelry items. The mesh is surrounded by a flexible fabric frame, permitting the assembly, with jewelry attached, to be rolled into a cylindrical configuration for storage or transport. The apparatus is adaptable to being suspended from a coat hanger.

The foregoing approaches alleviate the problem of a tangled jumble of jewelry in the bottom of a pouch. They also are foldable into a small volume and adaptable to hanging in a closet. They all suffer from the disadvantage that they are obviously carrying cases for small items, and thus would attract the attention of a thief searching the closet for valuables. It is therefore desirable to have a jewelry holder that keeps items separate, visible and accessible, that collapses to a small volume for packing, that protects items from scratching, and that looks like an ordinary article of clothing when hung in a closet.

SUMMARY OF THE INVENTION

The present invention is a jewelry holder designed to be inconspicuous in a closet. In one embodiment, the external structure is a piece of fabric material designed to resemble a blouse or sweater. The holder is designed to be hung from a standard type clothes hangar, and is closed in front using buttons, a zipper, or other fastening device. On the inside of the holder, a plurality of fabric tabs, cords, loops, ribbons or pockets is attached, and these devices can support, contain or otherwise hold jewelry items. When the holder is closed, it looks like just another piece of clothing. When the holder is opened it conveniently displays the contained jewelry, allowing easy selection and removal of items. Once pieces are selected, the outer surface is closed in front and the container is again camouflaged against the rest of the hanging clothing.

BRIEF DESCRIPTION THE DRAWINGS

Figure 3A:
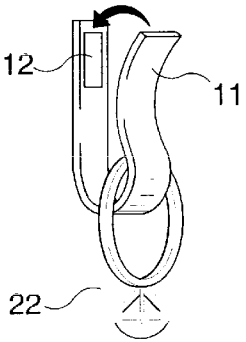
Figure 3B:
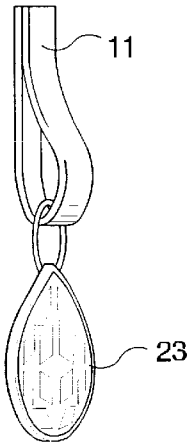

FIGS. 3*a* and 3*b,* 4 and 5 shows details of how various jewelry items attach to the invention.

Figure 6:
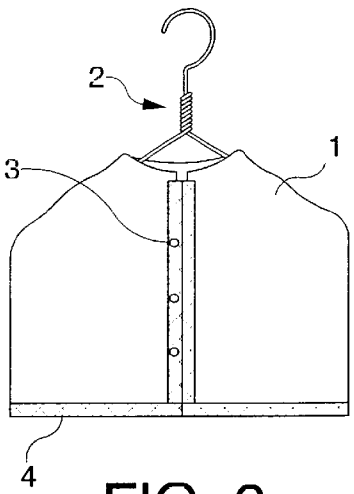

FIG. 6 shows the invention in a closed position.

DETAILED DESCRIPTION

Figure 1:
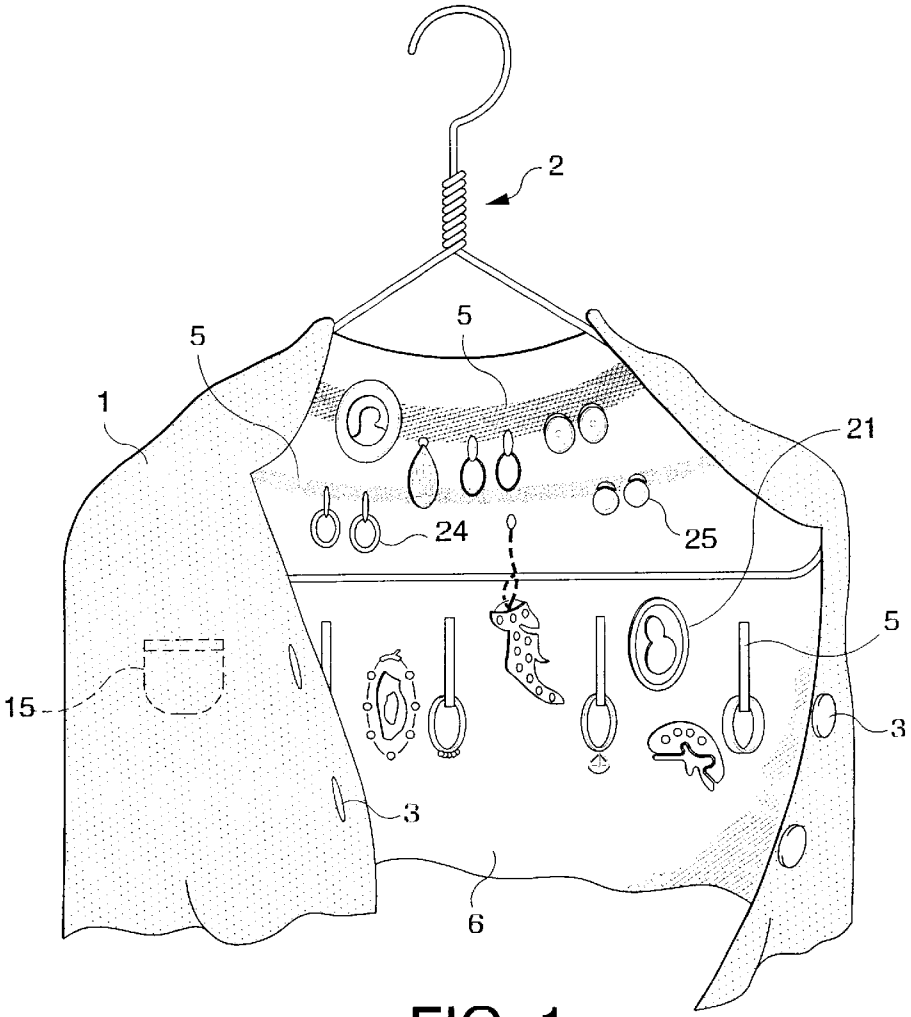
FIG. 1 shows one embodiment of the present invention as hanging from a conventional coat hanger.

A preferred embodiment of the inventive device is shown in FIG. 1. Fabric exterior 1 is constructed in the general shape of an article of clothing, like a blouse, shirt or sweater and adapted to hang from hanger 2. Although not necessary for functioning, artificial sleeves may be included in the overall shape. The general shape may also be that of a standard protective padded hanger often used with formal clothing, which resembles the shape of FIG. 6. The fabric exterior has a closure mechanism 3 in its center front, which may consist of buttons and button holes, Velcro® hook and loop tape fastener opposing strips, a zipper, or snaps and snap receptors. These are generally arrayed in a vertical pattern down the center front of the device, and when closed make the device appear to be a buttoned article of clothing on a hanger.

A closure 4 along the bottom of the device (seen in FIG. 6), preferably of Velcro® or a zipper, is desirable to catch any items that may have fallen inside the device.

Figure 4:
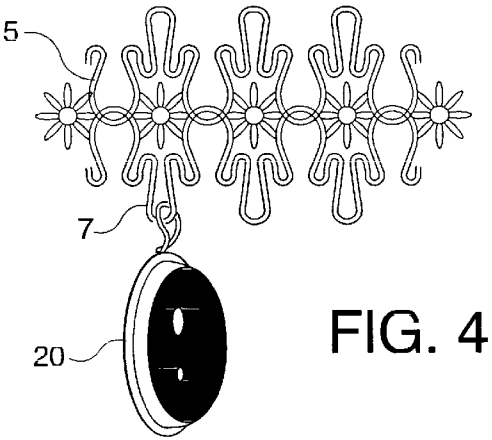
Figure 5:
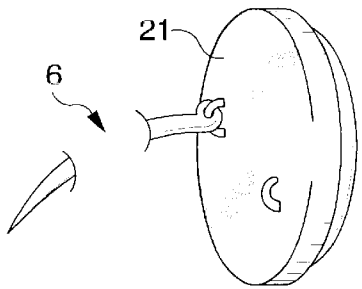

Inside the fabric are a plurality of jewelry containing devices 5. These are sewn or otherwise permanently attached to the inside back surface 6 of the fabric. These may be ribbons, tabs, hooks, strips, or small pockets, and are adapted to securely hold small items such as jewelry. FIGS. 3 and 4 show examples of attachment of jewelry pieces to holders on the inside of the device. In FIG. 4, enhancer 20 is attached to a loop 7 on ribbon 5. Decorative pin 21 is pinned through the fabric of inside back surface 6 (See FIG. 5). Ring 22 and pendant 23 are secured by velcro closure 12 of tab 11. (FIGS. 3*a* and 3*b*). Pierced-ear style earrings 24 and clip style earrings 25 attach to strip 5 in FIG. 1. Also in FIG. 1, pocket 15 is affixed to the inside front surface, though it could also be on the inside back surface 6.

Figure 2:
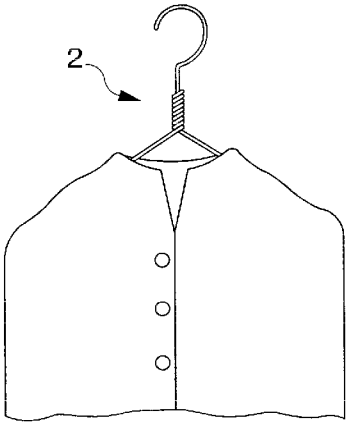
FIG. 2 shows an ordinary article of clothing on a hanger for comparison.

The storage device, with or without attached jewelry items, may conveniently be folded for storage or for travel packing. In use, it is simply draped over a standard clothes hanger 2 and hung in a closet. With the front closed, the device appears to a casual observer to be just another item of clothing among the many in the closet, as illustrated in FIG. 2. Even if it falls to the floor, the jewelry items are safely secured in position, so they remain in their proper locations when the device is replaced on its hanger.

For selecting and removing jewelry items, the device may be opened at the front and along the bottom, and accessed while it remains on the hanger. It may also be laid on a table or bed with the front open. The user readily sees all the jewelry items, kept separate and easy to identify and remove.

The fabric exterior may be constructed of any of a variety of materials for esthetic or wardrobe coordination appeal. For example, the exterior might be a silk blend, denim, a quilted fabric similar to a padded coat hanger, broadcloth, canvas, or any other fabric. Decorative ribbon might outline the edges of the fabric or be applied in another location, as might appliques of flower patterns or other fanciful designs. The interior surface is preferably padded to protect the contained jewelry, although the amount of padding varies and a construction with no padding at all would be functional. Desirable padding materials for the interior surface include cotton/polyester fleece, quilted fabric, and robe velour.

The interior may also be designed for esthetic appeal through selection and placement of the devices for holding jewelry. For example, woven ribbon in a daisy or crown pattern makes for an appealing jewelry securing device. Decorative and functional small pockets could be affixed to either the interior rear surface or the interior front surface.

Although a preferred embodiment of the invention has been shown and described, it will be obvious that other adaptations and modifications can be made without departing from the true spirit and scope of the invention.

I claim:

1. A hanging storage device for small items, comprising a fabric shell in the shape of an article of clothing, adapted to be hung from a standard coat hanger; said shell having a top end and a bottom end and front and rear sides, each side having an internal surface and an external surface; a plurality of attachment means adapted to secure small items, affixed to the rear internal surface; a split in the front side so that the front side may be opened to expose the internal surface of the rear side or closed; closure means for securely closing the front side; and a substantially closed bottom end so that the small items will not fall out.

2. The invention of claim 1 wherein the attachment means include at least one fabric strip adhered to the rear internal surface.

3. The invention of claim 2 further including at least one closeable tab affixed to the rear internal surface.

4. The invention of claim 3 wherein the closeable tab incorporates a hook and loop tape fastening means.

5. The invention of claim 1 wherein the attachment means include at least one decorative ribbon affixed to the internal rear surface.

6. The invention of claim 1 further including an openable and closeable bottom edge along which the front and rear sides meet.

7. The invention of claim 1 further including at least one closeable pocket affixed to an internal surface.

8. The invention of claim 1 wherein the front and rear internal surfaces are made of padded fabric.

9. A hanging storage device for small items, comprising a fabric shell in the shape of a protective padded hangar, adapted to be hung from a standard coat hanger; said shell having a top end and a bottom end and front and rear sides, each side having an internal surface and an external surface; a plurality of attachment means adapted to secure small items, affixed to the rear internal surface; a split in the front side so that the front side may be opened to expose the internal surface of the rear side or closed; closure means for securely closing the front side; and a substantially closed bottom end so that small items will not fall out.

10. The invention of claim 9 further including an openable and closeable bottom edge along which the front and rear sides meet.

* * * * *